United States Patent [19]

Marlin

[11] Patent Number: 5,049,035

[45] Date of Patent: Sep. 17, 1991

[54] BLADED DISC FOR A TURBOMACHINE ROTOR

[75] Inventor: Francois M. P. Marlin, Melun, France

[73] Assignee: Societe Nationale d'Etude et de Construction de Moteurs d'Aviation "S.N.E.C.M.A.", Paris, France

[21] Appl. No.: 441,045

[22] Filed: Nov. 24, 1989

[30] Foreign Application Priority Data

Nov. 23, 1988 [FR] France ..... 88 15234

[51] Int. Cl.[5] ..... F01D 5/22

[52] U.S. Cl. ..... 416/193 A; 416/220 R

[58] Field of Search ..... 416/193 A, 204 A, 219 R, 416/220 R, 244 R, 244 A, 245 R

[56] References Cited

U.S. PATENT DOCUMENTS

| | | | |
|---|---|---|---|
| 2,873,088 | 2/1959 | Neumann | 416/220 X |
| 2,967,043 | 1/1961 | Dennis | 416/212 A X |
| 3,008,689 | 11/1961 | Morley et al. | 416/193 A |
| 3,294,364 | 12/1966 | Stanley | 416/219 R |
| 3,393,862 | 7/1968 | Harrison | 416/193 A X |
| 3,712,757 | 1/1973 | Goodwin | 416/245 |
| 3,761,200 | 9/1973 | Gardiner | 416/193 A X |
| 3,888,601 | 6/1975 | Glassburn | 416/193 A X |
| 4,033,705 | 7/1977 | Luebering | 416/220 R |

FOREIGN PATENT DOCUMENTS

| | | |
|---|---|---|
| 2413543 | 7/1979 | France . |
| 2006883 | 5/1979 | United Kingdom . |
| 2171151 | 8/1986 | United Kingdom . |

*Primary Examiner*—Edward K. Look
*Assistant Examiner*—James A. Larson
*Attorney, Agent, or Firm*—Oblon, Spivak, McClelland, Maier & Neustadt

[57] ABSTRACT

A bladed disc of a turbomachine rotor comprising an array of blades evenly disposed around the rim of the disc and separate platforms secured to the disc between the blades, each platform comprising a plate and a mounting foot at each axial end of the plate by which the platform is secured to the rim of the disc, at least one of the feet being secured by a C-shaped clamp which rigidly connects the foot to a tooth-like element of the disc adjacent the rim and which is locked axially in position by a flange of an adjacent element of the rotor.

6 Claims, 2 Drawing Sheets

BLADED DISC FOR A TURBOMACHINE ROTOR

BACKGROUND OF THE INVENTION

1. Field of the invention

The present invention relates to bladed discs fitted with separate blades and platforms, and is particularly concerned with such a disc for a fan or a compression stage of a turbojet aero-engine.

2. Discussion of the prior art

In the construction of turbomachine rotors, particularly for the applications mentioned above, it is known to arrange the construction of the blades in several parts in order, for example, to permit unitary dismantling in the case of blades of large chord and substantial twist, and/or to facilitate their manufacture, especially the machining operations. For example, GB Patent No.2 171 151 describes a rotor with blades which have only a vane and a root, separate platforms between the blades each being mounted by a bulb-shaped root in an intermediate socket provided in the rim of the disc between two sockets carrying the roots of the adjacent blades. However, this securing method requires additional sockets on the disc supporting the blades and is not entirely satisfactory for all applications.

SUMMARY OF THE INVENTION

An object of the present invention therefore is to provide separate inter-blade platforms for turbomachine rotors with improved means for securing them to a disc which ensures their retention both radially and axially while taking into account the mass reduction requirements which are obviously desirable for rotating parts and which is a significant factor in the aeronautical applications with which the invention is concerned.

According to the invention there is provided a bladed disc of a turbomachine rotor comprising:

- a disc having front and rear faces with respect to the axis of rotation of said rotor, and a rim extending peripherally of said disc between said front and rear faces thereof, said rim having front and rear bearing surfaces adjacent said front and rear faces of said disc,
- an array of blades having only a vane portion and a root portion disposed evenly around said rim of said disc and secured thereto at said root portions of said blades,
- a plurality of separate platforms disposed on said rim between said blades, each of said platforms comprising
- a plate defining an inner wall of the main gas flow path through said rotor, and
- an element at each axial end of said plate forming front and rear securing feet which cooperate respectively with said front and rear bearing surfaces on said rim, and
- securing means for attaching said front and rear feet of each said platform to said disc, said securing means for at least one of said front and rear feet comprising
- a tooth-like element formed on the corresponding one of said front and rear faces of said disc adjacent said rim,
- a substantially C-shaped clamp firmly connecting said foot to said tooth-like element, and
- a neighboring element of said rotor fixed to said disc, said neighboring element having a flange for engaging said clamp in a manner so as to ensure axial locking thereof.

Further features and advantages of the invention will become apparent from the following description of preferred embodiments of the invention with reference to the attached drawings.

DESCRIPTION OF THE PREFERRED EMBODIMENTS

The embodiments of the invention shown in FIGS. 1 to 4*b* relate to a turbojet fan in which the movable rotor stage includes blades of great chord associated with separate inter-blade platforms.

Figure 1:
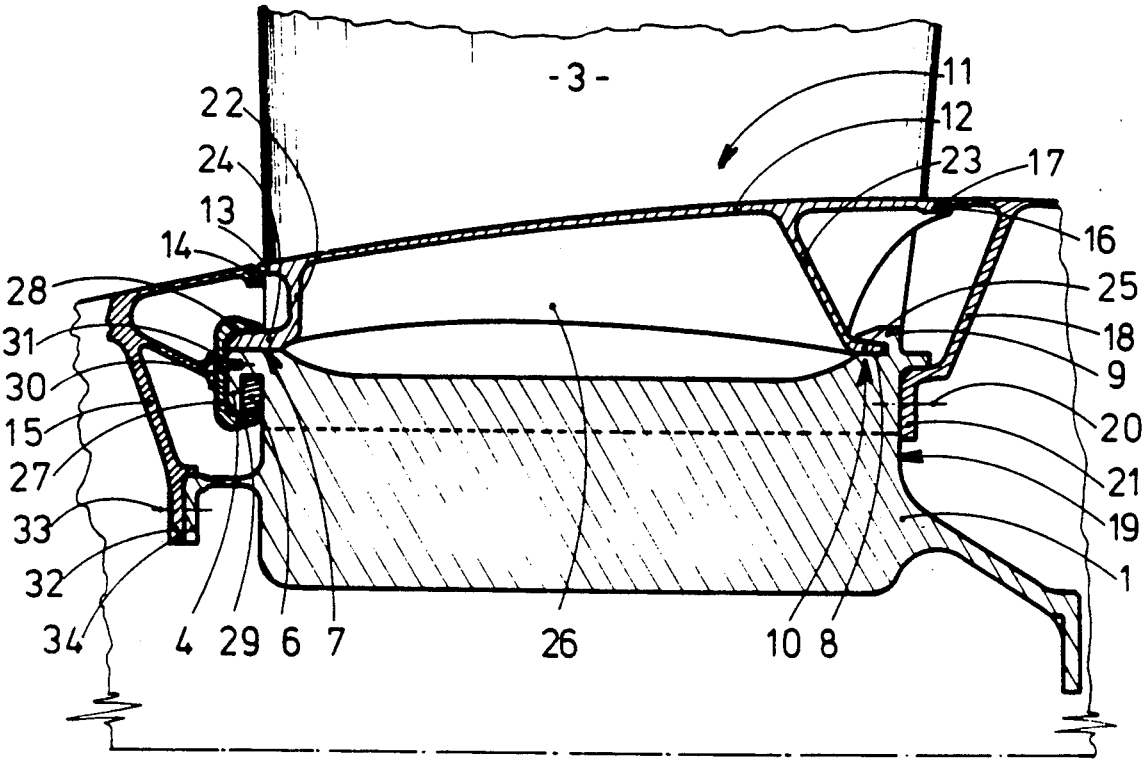
FIG. 1 is a sectional view of part of a bladed disc in accordance with a first embodiment of the invention, taken in a plane passing through the axis of rotation of the disc.
Figure 2:
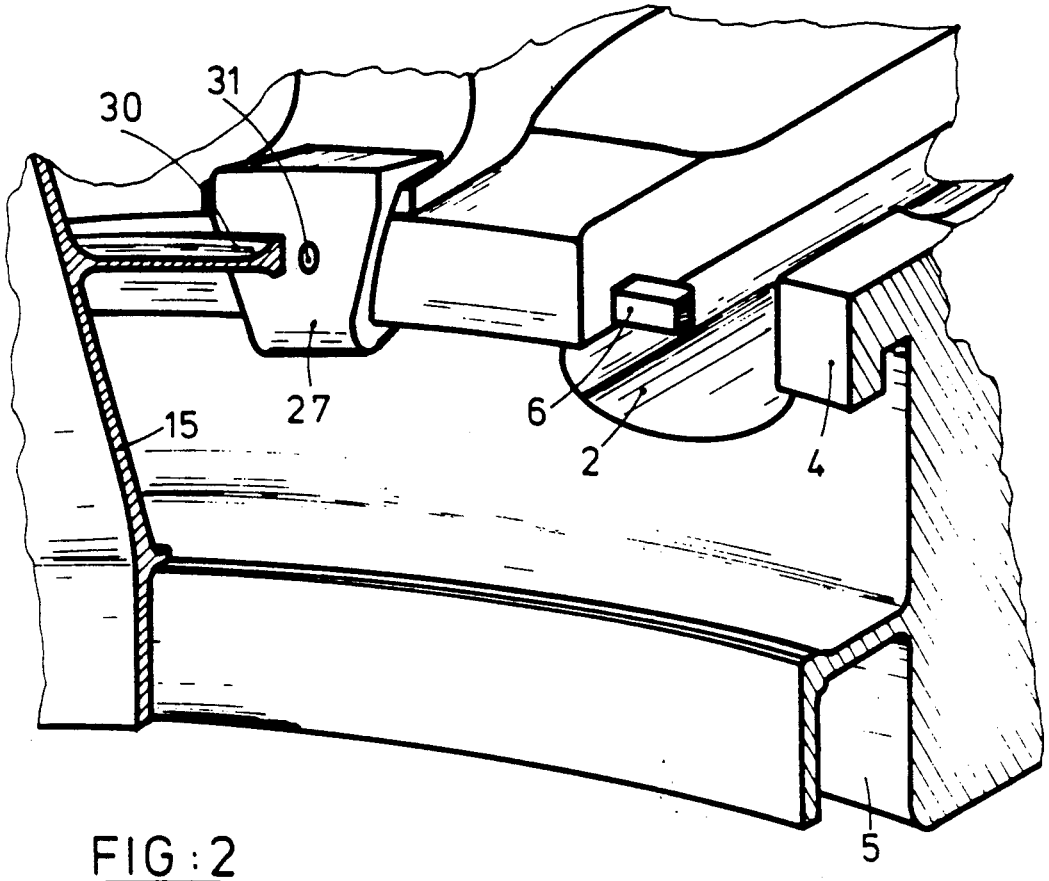
FIG. 2 is a diagrammatic, partly cut-away perspective view of part of the bladed disc shown in FIG. 1.

In the embodiment shown in FIGS. 1 and 2, the periphery of a fan disc 1 has a plurality of axially oriented grooves arranged evenly around the rim of the disc and forming sockets 2 in which the complementary roots of the fan blades 3 are held. The rim of the disc 1 is extended axially at its front face 5, the front and rear locations being defined relative to the normal direction of flow of the gases in the turbomachine, by elements which form teeth 4 and are undercut to define a groove for receiving a ring 6 for axially locking the blades 3 in position. Adjacent its front edge the rim of the disc 1 has a cylindrical bearing surface 7, and adjacent its rear edge there is a similar cylindrical bearing surface 8 surmounted by an annular boss 9 to form an annular groove 10. The disc 1 is also fitted with platforms 11 separate from the blades 3.

In this embodiment the platforms 11 are made of metal which, for use in a turbojet fan, is preferably a light metal such as titanium or one of its alloys. Each platform 11 is situated between two consecutive blades 3 and comprises an upper plate 12 which delimits the inner wall of the main flow path of the gases, both peripherally between the two blades 3, and longitudinally from where the front edge 13 of the plate 12 connects with the rear edge 14 of a support 15 for the inlet cone of the fan to where the rear edge 16 includes, for example, an eyelet for connection to the front outer edge 17 of an intermediate flange 18 secured to the rear face 19 of the disc 1, for example by a screw (indicated at 20) through a fixing flange 21. Sealing of the main flow path is thus ensured on both the front and rear sides of the disc.

The plate 12 is carried by front and rear legs 22,23 respectively, each terminating at a fixing foot 24,25. A strengthening rib 26 is mounted centrally under the inner face of the plate 12, extending axially between the two legs 22 and 23. The rear foot 25 locates within the annular groove 10 of the disc 1 and is supported on the cylindrical bearing surface 8, and the front foot 24 is supported on the cylindrical bearing surface 7. A vertically arranged, generally C-shaped clamp element 27 holds the front foot 24 in position, the upper arm 28 of the clamp cooperating with the upper surface of the foot 24, and the lower arm 29 cooperating with the inner faces of the corresponding tooth 4 and the ring 6. A flange 30 of the inlet cone support 15 acts on the clamp 27 to ensure axial locking of the assembly. The clamp 27 and corresponding tooth 4 of each platform 11 also have registering holes in which a positioning peg 31 is placed.

The platforms 11 are assembled as follows. The rear foot 25 of each platform is introduced into the groove 10 of the disc 1 and the front foot 24 is laid on the front cylindrical bearing surface 7 of the disc 1. Each clamp 27 is then placed in position after fitting the peg 31 in the corresponding disc tooth 4. The inlet cone support 15 is then placed in position with the flange 30 of its rear part acting on the clamps 27, and a fixing flange 32 of the support 15 is secured by bolts (indicated at 33) to a flange 34 integral with the front face of the disc 1.

Figure 3:
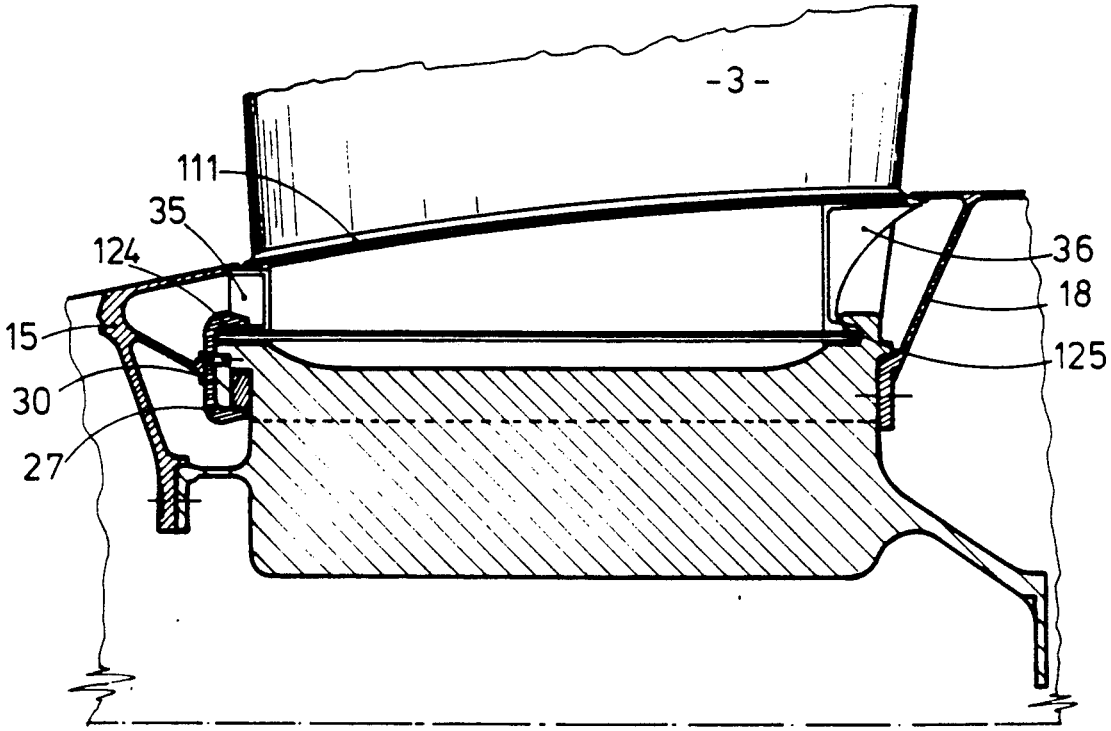
FIG. 3 is a sectional view similar to that of FIG. 1 but showing a bladed disc in accordance with a second embodiment of the invention.
Figure 4A:
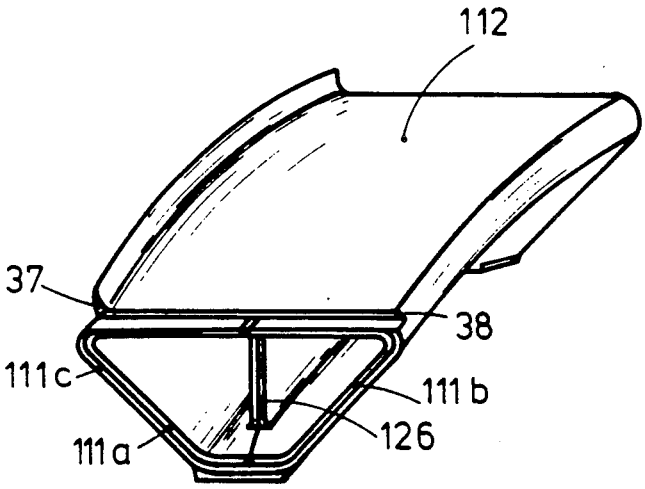
FIG. 4*a* is a diagrammatic perspective view of a platform of the second embodiment shown in FIG. 3; and, FIG. 4*b* is a diagrammatic perspective view of a reinforcement member associated with the platform shown in FIG. 4*a*.
Figure 4B:
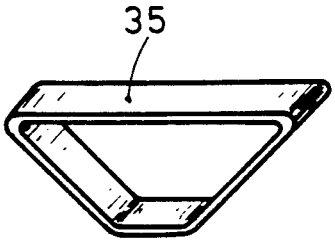

An alternative embodiment of the invention is shown in FIGS. 3,4*a*,4*b*, for which the following description uses the same reference numerals as in FIGS. 1 and 2 for parts which are identical to corresponding parts of the first embodiment, and uses reference numerals increased by one hundred for those parts which have been modified. In the embodiment of FIGS. 3,4*a* and 4*b* the platforms 111 are made of a composite material, each platform 111 comprising two box-shaped elements 111*a* and 111*b* of generally triangular or trapezoidal section disposed abreast of each other along one side, thus forming a central rib 126. These box-sectioned elements 111*a* and 111*b* may be obtained by winding or draping fabrics of a composite material and, after assembly, they are rigidly connected by a further winding or draping of a composite material fabric to form an outer skin 111*c* and also an upper plate 112.

Each platform 111 also comprises a reinforcing member 35,36 at its front and rear edges respectively, these reinforcing members also forming the front and rear feet 124 and 125 for securing the platform. FIG. 4*b* shows the construction of the reinforcing member 35.

The peripheral side edges of the platform 111 each receive a seal, respectively 37 and 38, to ensure sealing and connection between the platform 111 and the adjacent blade 3 at each edge.

The other elements of this embodiment are as described with reference to FIGS. 1 and 2, particularly regarding the engagement of the rear foot 125 in the annular groove 10 of the disc 1, and the securing of the front foot 124 by means of a clamp 27 axially locked in position by the flange 30 of the inlet cone support 15. The method of assembly is also the same as previously described with reference to FIGS. 1 and 2.

Other embodiments in accordance with the invention may be readily envizaged from those which have been described and shown herein. For example, if for a particular application it is considered that the boss 9 of the disc 1 forming the annular groove 10 is unacceptably fragile, the platform may be arranged to be secured at its rear edge in the same way as at the front edge, i.e. using clamps 27.

Obviously, numerous modifications and variations of the present invention are possible in light of the above teachings. It is therefore to be understood that within the scope of the appending claims, the invention may be practiced otherwise than as specifically described herein.

I claim:

1. In a turbomachine rotor having an axis of rotation, a bladed disc comprising:

a disc having front and rear faces with respect to said axis of rotation, and a rim extending peripherally of said disc between said front and rear faces thereof, said rim having front and rear bearing surfaces adjacent said front and rear faces of said disc, an array of blades having only a vane portion and a root portion disposed evenly around said rim of said disc and secured thereto at said root portions of said blades, a plurality of separate platforms disposed on said rim between said blades, each of said platforms comprising a plate defining an inner wall of the main gas flow path through said rotor, and an element at each axial end of said plate forming front and rear securing feet which cooperates respectively with said front and rear bearing surfaces on said rim, and securing means attaching said front and rear feet of each said platform to said disc, said securing means for said front foot comprising a tooth-like element formed on the corresponding front face of said disc adjacent said rim, a substantially C-shaped clamp firmly connecting said foot to said tooth-like element, and a neighboring element of said rotor fixed to said disc, said neighboring element having a flange engaging said clamp in a manner so as to ensure axial locking thereof.

2. A bladed disc according to claim 1, wherein said tooth-like element is formed on said front face of said disc and is provided with an undercut recess receiving a blade locking ring, the top of said clamp engaging said front foot of said platform, and the bottom of said clamp engaging said tooth-like element and said locking ring, and wherein said securing means for the rear foot of said platform comprises a boss on said rim adjacent said rear face of said disc, said boss defining, with said rear bearing surface, an annular groove which receives and retains said rear foot.

3. A bladed disc according to claim 1, wherein the face of said tooth-like element and said clamp are provided with registering holes, and a positioning peg is received in said holes.

4. A bladed disc according to claim 1, wherein each of said platforms is made of metal and includes front and rear legs connecting said plate to said front and rear securing feet respectively, and a strengthening rib joined to the inner face of said plate and extending between said front and rear legs, and wherein each axial end of said plate of each said platform cooperates, respectively, with an adjacent edge of each of two neighboring rotor elements so as to ensure the sealing and continuity of said inner wall of said main gas flow path.

5. A bladed disc according to claim 1, wherein each of said platforms is made of a composite material and is formed by two elements of substantially triangular section disposed abreast of each other, and an outer skin rigidly connecting said elements together and forming the said plate of the platform, said front and rear securing feet of said platform being formed by a strengthening member at each axial end thereof.

6. A bladed disc according to claim 5, wherein said plate of said platform is provided with a seal on each peripheral edge thereof to ensure the connection between the platform and the adjacent blades.

* * * * *